US009373467B2

(12) United States Patent
Naka et al.

(10) Patent No.: US 9,373,467 B2
(45) Date of Patent: Jun. 21, 2016

(54) ELECTROMAGNETIC CONTACTOR

(75) Inventors: Yasuhiro Naka, Kounosu (JP); Kouetsu Takaya, Kounosu (JP); Kenji Suzuki, Kounosu (JP); Yuji Shiba, Kounosu (JP); Masaru Isozaki, Ichihara (JP)

(73) Assignees: FUJI ELECTRIC FA COMPONENTS & SYSTEMS CO., LTD., Tokyo (JP); FUJI ELECTRIC CO., LTD., Kawasaki-Shi (JP)

( * ) Notice: Subject to any disclaimer, the term of this patent is extended or adjusted under 35 U.S.C. 154(b) by 0 days.

(21) Appl. No.: 14/006,513

(22) PCT Filed: Apr. 3, 2012

(86) PCT No.: PCT/JP2012/002329

§ 371 (c)(1),
(2), (4) Date: Oct. 3, 2013

(87) PCT Pub. No.: WO2012/157172

PCT Pub. Date: Nov. 22, 2012

(65) Prior Publication Data

US 2014/0014622 A1 Jan. 16, 2014

(30) Foreign Application Priority Data

May 19, 2011 (JP) ..... 2011-112909

(51) Int. Cl.
*H01H 33/14* (2006.01)
*H01H 9/44* (2006.01)
(Continued)

(52) U.S. Cl.
CPC ..... *H01H 33/14* (2013.01); *H01H 9/443* (2013.01); *H01H 33/182* (2013.01); *H01H 50/14* (2013.01);
(Continued)

(58) Field of Classification Search
CPC ..... H01H 50/38; H01H 50/54; H01H 67/02; H01H 73/18; H01H 9/342; H01H 9/443; H01H 9/446; H01H 33/14; H01H 33/182; H01H 50/14; H01H 51/065
USPC ..... 218/4, 23, 26, 31, 22, 150, 158; 200/243, 244; 335/205, 207, 278, 302, 335/78, 153, 201, 202
See application file for complete search history.

(56) References Cited

U.S. PATENT DOCUMENTS 3,613,040 A 10/1971 Fluder et al.
4,367,448 A * 1/1983 Nishizako ..... 335/201
(Continued)

FOREIGN PATENT DOCUMENTS

CN 101388303 A 3/2009
DE 967984 C 1/1958
(Continued)

OTHER PUBLICATIONS

Machine translation of JP 2008-226547 (orig. doc. published Sep. 25, 2008).*
(Continued)

*Primary Examiner* — Renee Luebke
*Assistant Examiner* — William Bolton
(74) *Attorney, Agent, or Firm* — Manabu Kanesaka

(57) ABSTRACT

An electromagnetic contactor includes a contact device having a contact housing case formed from an insulating material and housing a pair of fixed contacts and a movable contact disposed to be capable of contacting to and separating from the pair of fixed contacts. On an inner peripheral surface of the contact housing case along the movable contact, arc extinguishing permanent magnets magnetized so that magnetic pole faces facing each other have same polarity are disposed to be near the movable contact.

7 Claims, 15 Drawing Sheets

(51) Int. Cl.

| | |
|---|---|
| ***H01H 50/14*** | (2006.01) |
| ***H01H 50/38*** | (2006.01) |
| ***H01H 51/06*** | (2006.01) |
| ***H01H 33/18*** | (2006.01) |
| ***H01H 50/16*** | (2006.01) |
| ***H01H 50/02*** | (2006.01) |

(52) U.S. Cl.
CPC ..... *H01H 50/163* (2013.01); *H01H 50/38* (2013.01); *H01H 51/065* (2013.01); *H01H 2050/025* (2013.01)

(56) References Cited

U.S. PATENT DOCUMENTS

| | | | | |
|---|---|---|---|---|
| 5,103,199 | A * | 4/1992 | Ootsuka | 335/133 |
| 5,369,237 | A * | 11/1994 | Mejerl et al. | 200/524 |
| 5,546,061 | A * | 8/1996 | Okabayashi et al. | 335/78 |
| 5,892,194 | A | 4/1999 | Uotome et al. | |
| 6,700,466 | B1 * | 3/2004 | Yamamoto et al. | 335/132 |
| 6,975,194 | B2 * | 12/2005 | Nishida | H01H 51/2209 335/132 |
| 7,541,901 | B2 * | 6/2009 | Nakano et al. | 335/201 |
| 2003/0020574 | A1 | 1/2003 | Sato et al. | |
| 2005/0148216 | A1 | 7/2005 | Nishida et al. | |
| 2009/0237191 | A1 | 9/2009 | Yano et al. | |
| 2009/0322453 | A1 | 12/2009 | Kawaguchi et al. | |
| 2011/0181381 | A1 * | 7/2011 | Sasaki et al. | 335/78 |
| 2012/0145675 | A1 * | 6/2012 | Zhou | H01H 9/443 218/150 |
| 2013/0012037 | A1 * | 1/2013 | Enomoto et al. | 439/39 |

FOREIGN PATENT DOCUMENTS

| | | | | |
|---|---|---|---|---|
| EP | 2141723 | A2 | 1/2010 | |
| GB | 1262846 | A | 2/1972 | |
| JP | H06-203725 | A | 7/1994 | |
| JP | 2001-118450 | A | 4/2001 | |
| JP | 2001-118451 | A | 4/2001 | |
| JP | 2008226547 | * | 9/2008 | H01H 50/38 |
| JP | 2011-204476 | A | 10/2011 | |
| JP | 2011-204477 | A | 10/2011 | |
| JP | 2011-204478 | A | 10/2011 | |
| JP | 2012-199120 | A | 10/2012 | |

OTHER PUBLICATIONS

Japan Patent Office, "Office Action for JP 2011-112909," Jan. 13, 2015.

China Patent Office, "Office Action for CN 201280017365.4," Jan. 30, 2015.

Europe Patent Office, Search Report for EP 12785565.8, May 12, 2015.

* cited by examiner

ELECTROMAGNETIC CONTACTOR

RELATED APPLICATIONS

The present application is National Phase of International Application No. PCT/JP2012/002329 filed Apr. 3, 2012, and claims priority from Japanese Applications No. 2011-112909 filed May 19, 2011.

TECHNICAL FIELD

The present invention relates to an electromagnetic contactor wherein fixed contacts and a movable contact are disposed in a contact housing case.

BACKGROUND ART

As an electromagnetic contactor used in a high-current direct current power circuit, heretofore, there has been proposed a plunger type electromagnetic contactor including a housing 500 housing a pair of fixed contacts 501, 502 disposed to maintain a predetermined interval, a movable contact bearing body 505 including at the two respective ends thereof a pair of movable contacts 503, 504 disposed to face the pair of fixed contacts 501, 502 so as to be capable of contacting to and separating from the pair of fixed contacts 501, 502, and a pair of arc extinguishing means 506, 507 for extinguishing arcs generated in each of the contact gaps between the pair of fixed contacts 501, 502 and the pair of movable contacts 503, 504, as shown in FIGS. 12 and 13 (for example, refer to PTL 1).

Herein, each of the pair of arc extinguishing means 506, 507 is configured of a pair of permanent magnets fixed in the housing so that the magnetic pole faces facing each other across the contact gap have opposite polarities.

A description of an arc extinguishing principle of the heretofore known example described above will be given using FIGS. 13 to 16. As shown in FIG. 13, when the movable contact bearing body 505 is moved from an energized state wherein current flows from the fixed contact 501 through the movable contacts 503, 504 toward the fixed contact 502 by contacting the movable contacts 503, 504 to the fixed contacts 501, 502, by a solenoid portion not shown in the drawing in a direction in which the movable contacts 503, 504 move upward away from the fixed contacts 501, 502, and placed in a state in which the current is interrupted, arcs 508 are generated between each fixed contact 501, 502 and each respective movable contact 503, 504, as shown in FIG. 14.

At this time, as the pair of arc extinguishing means 506, 507 is disposed in a direction perpendicular to the arcs 508, and as shown in FIG. 15, magnetic fluxes $\phi$ therefrom are generated in a direction perpendicular to the plane of the drawing, Lorentz forces that direct the arcs 508 outward in the array direction of the fixed contacts 501, 502 in accordance with Fleming's left-hand rule act on the magnetic fluxes $\phi$ and the direction of current, and the arcs are extended to the side of an arc extinguishing space 509 disposed on the outer side in the array direction of the fixed contacts 501, 502 shown in FIG. 15, and are extinguished.

Also, when the direction in which the current is conducted is opposite to a direction in which the current flows from the fixed contact 502 to the fixed contact 501 side via the movable contacts 504, 503, arcs generated between each fixed contact 501, 502 and each respective movable contact 503, 504 are extended inward in the array direction of the fixed contacts 501, 502, and are extinguished, as shown in FIG. 16.

However, in the heretofore known example described in the PTL 1, the current is interrupted by the arcs being extended to make an arc voltage higher than a power supply voltage. As the arc voltage is determined by the product of an arc electric field value and arc length, it is necessary to increase the arc electric field value or increase the arc length when intending to interrupt a higher power supply voltage.

An arc electric field value in the atmosphere has been determined by the internal pressure and gas species, and it is possible to increase an arc electric field, in general, by increasing the pressure of gas, or by using, for example, a gas such as hydrogen with a large arc electric field. However, there is an unsolved problem that it is necessary to tightly seal a receptacle or increase the strength of structure when the pressure of gas is high. Also, as the dielectric strength voltage deteriorates when using a gas such as hydrogen with a large arc electric field, it is necessary to increase the gap between the contacts, there is an unsolved problem such as the coil of the solenoid portion that drives the movable contact bearing body so as to cause the movable contact bearing body to advance and withdraw is large.

Meanwhile, when increasing the arc length, it is necessary to provide an arc space large enough to achieve the arc length, and there is an unsolved problem that the housing becomes larger.

In order to solve these unsolved problems, there is proposed an electromagnetic relay wherein arc extinguishing magnetic bodies are disposed on each outer side in the array direction of the fixed contacts so that the opposing faces thereof are different poles, and arc extinguishing spaces for extending arcs with Lorentz forces based on the magnetic fluxes of the arc extinguishing magnetic bodies are disposed at each end of the arc extinguishing magnetic bodies in a direction perpendicular to the array direction of the fixed contacts and perpendicular to the switching direction of the fixed contacts and movable contacts (for example, refer to PTL 2).

CITATION LIST

Patent Literature

PTL 1: JP-A-7-235248
PTL 2: JP-A-2008-226547

SUMMARY OF INVENTION

Technical Problem

However, in the heretofore known example of the heretofore described PTL 2, as the arc extinguishing magnetic bodies are disposed on the outer side in the array direction of the fixed contacts so that the opposing faces thereof are different poles, magnetic fluxes $\phi$ are generated by the arc extinguishing magnetic bodies such that a magnetic flux from the N-pole of each of arc extinguishing magnetic bodies 511, 512 disposed on each longitudinal direction end side of the movable contact 510, and flowing directly toward the S-pole of the same arc extinguishing magnetic body, becomes mainstream at each end in a width direction perpendicular to the longitudinal direction of the movable contact 510, and a magnetic flux from the N-pole of the arc extinguishing magnetic body 512 toward the S-pole of the arc extinguishing magnetic body 511 is generated in a central portion in the width direction.

Herein, the magnetic flux is distributed along the line G-G passing through a contact portion of the movable contact 510 on the arc extinguishing magnetic body 512 side such that both width direction end portions of the arc extinguishing magnetic body 512 exhibit a maximum magnetic flux density, and the width direction central portion exhibits a minimum magnetic flux density, as shown in FIG. 18. In the same way, the width direction central portion of the arc extinguishing magnetic body 511 side contact portion also exhibits a minimum magnetic flux density. Because of this, a magnetic flux crossing each end contact portion of the movable contact 510 contacting the corresponding fixed contact decreases, and it is not possible to sufficiently secure Lorentz forces acting on arcs generated between the fixed contacts and movable contact when current is interrupted,—meaning that there is an unsolved problem that there is a fear that the arc remains between the contact points of the fixed contacts and movable contact.

A magnet with a retaining force is used in order to solve this unsolved problem, and it is necessary to use a large magnet, meaning that there is an unsolved problem that the electromagnetic contactor is increased in size.

Therefore, the invention, having been contrived focusing on the heretofore described unsolved problems of the heretofore known examples, has an object of providing an electromagnetic contactor wherein it is possible to reduce the size thereof while securing a sufficient arc extinguishing function regardless of the orientation of current flowing through contact portions.

Solution to Problem

In order to achieve the heretofore described object, an electromagnetic contactor according to one aspect of the invention includes a contact device having a contact housing case formed from an insulating material; a pair of fixed contacts housed inside the contact housing; and a movable contact housed inside the contact housing and disposed to be capable of contacting to or separating from the pair of fixed contacts. On an inner peripheral surface of the contact housing case along the movable contact, arc extinguishing permanent magnets magnetized, so that magnetic pole faces facing each other have same polarity, are disposed near the movable contact.

According to this configuration, when adopting a released state from a closed state wherein the movable contact is contacting the pair of fixed contacts, arcs are generated between the pair of fixed contacts and the movable contact. At this time, the pair of arc extinguishing permanent magnets is disposed, close to the movable contact, on the respective inner peripheral surfaces of the contact housing case so as to face each other across the movable contact, and the facing magnetic pole faces of these arc extinguishing magnetic bodies are magnetized with the same polarity.

Consequently, magnetic fluxes from the N-pole toward the S-pole of each of the arc extinguishing permanent magnets disposed facing each other, both cross arc generation portions between the pair of fixed contacts and the movable contact in the longitudinal direction of the movable contact, and it is possible to cause sufficient Lorentz forces to act, and thus possible to extend the arcs in a direction perpendicular to the longitudinal direction of the movable contact, and reliably extinguish the arcs. Moreover, as the distance between the arc extinguishing permanent magnets becomes shorter, arc extinguishing permanent magnets with weak magnetism are sufficient in order to obtain a necessary magnetic flux density, and it is also possible to reduce the cost of arc extinguishing permanent magnets.

Also, by disposing the permanent magnets on the respective inner peripheral surfaces of the contact housing case, it is possible to increase the distance between the side edges of the movable contact and the respective inner peripheral surfaces of the contact housing case, and thus possible to form necessary arc extinguishing spaces.

Also, it is preferable that the arc extinguishing permanent magnets are covered with an insulating member formed on the inner peripheral surface of the contact housing case.

According to this configuration, as the arc extinguishing permanent magnets are covered with the insulating member, it is possible to reliably prevent a contact failure from occurring due to a broken piece of the arc extinguishing permanent magnets being interposed between the contact faces of the pair of fixed contacts and the movable contact.

Also, in the electromagnetic contactor, the insulating member may include movable contact guide members that restrain rotation of the movable contact by making sliding contact with the movable contact.

According to this configuration, it is possible to reliably restrain the rotation of the movable contact with the movable contact guide members provided on the insulating member covering the arc extinguishing permanent magnets.

Advantageous Effects of Invention

According to the invention, as the arc extinguishing permanent magnets are disposed near the movable contact on the respective inner peripheral surfaces of the contact housing case in which the pair of fixed contacts and the movable contact are disposed to be capable of contacting to and separating from the fixed contacts, the density of magnetic fluxes crossing arc generation portions between the pair of fixed contact and the movable contact in the longitudinal direction of the movable contact can be made sufficient. Because of this, it is possible to apply arc extinguishing permanent magnets with low magnetism, and it is possible to obtain the advantageous effect of achieving a reduction in cost of the arc extinguishing permanent magnets.

Moreover, it is possible to increase the distance between the movable contact and the inner peripheral surfaces of the contact housing case by an amount equivalent to the thickness of the arc extinguishing permanent magnets, and thus possible to obtain the advantageous effect of securing sufficient arc extinguishing space.

DESCRIPTION OF EMBODIMENTS

Hereafter, a description will be given, based on the drawings, of embodiments of the invention.

Figure 1:
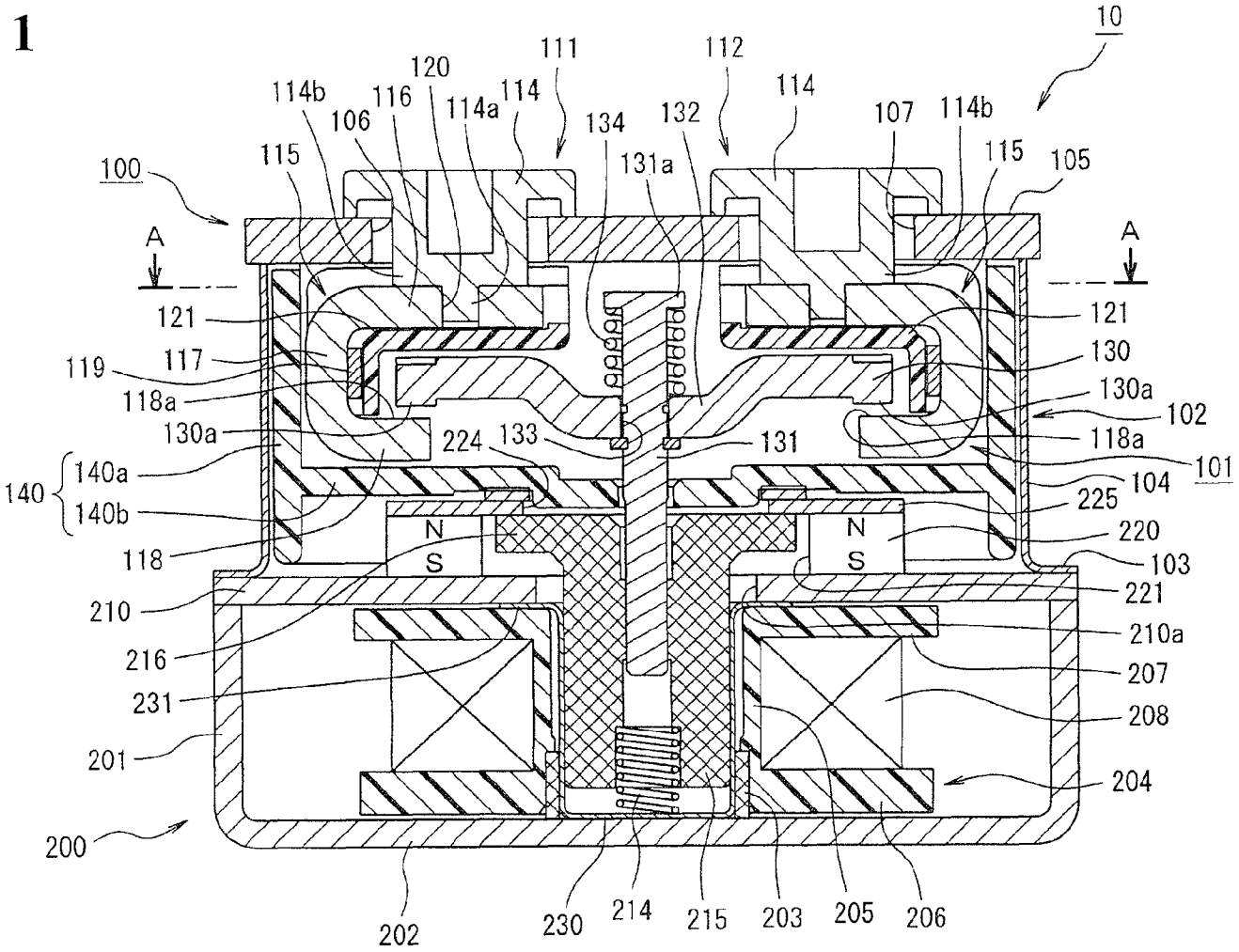
FIG. 1 is a sectional view showing one embodiment of an electromagnetic contactor according to the invention.
Figure 2B:
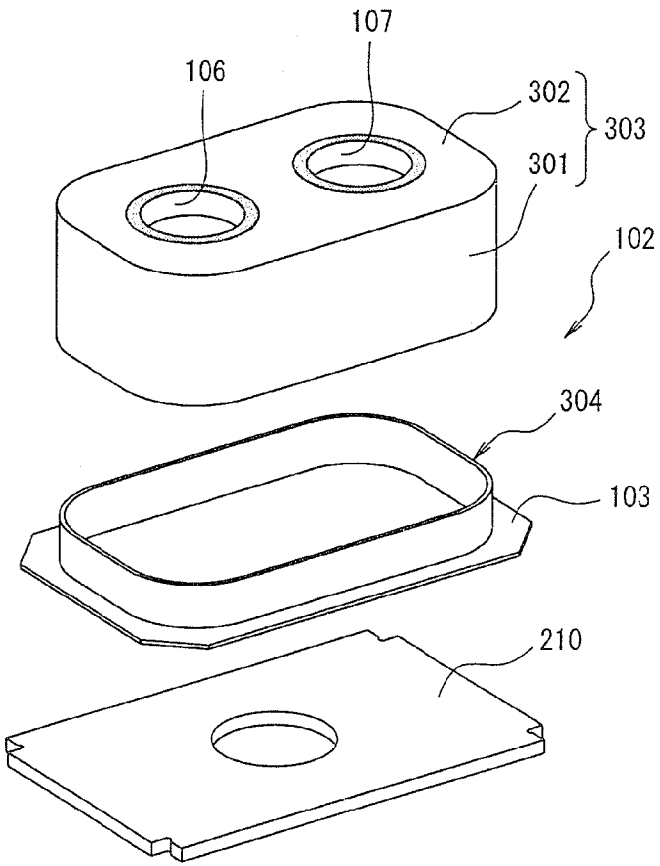
FIG. 2(*a*), 2(*b*) are exploded perspective views of a contact housing case.
Figure 2A:
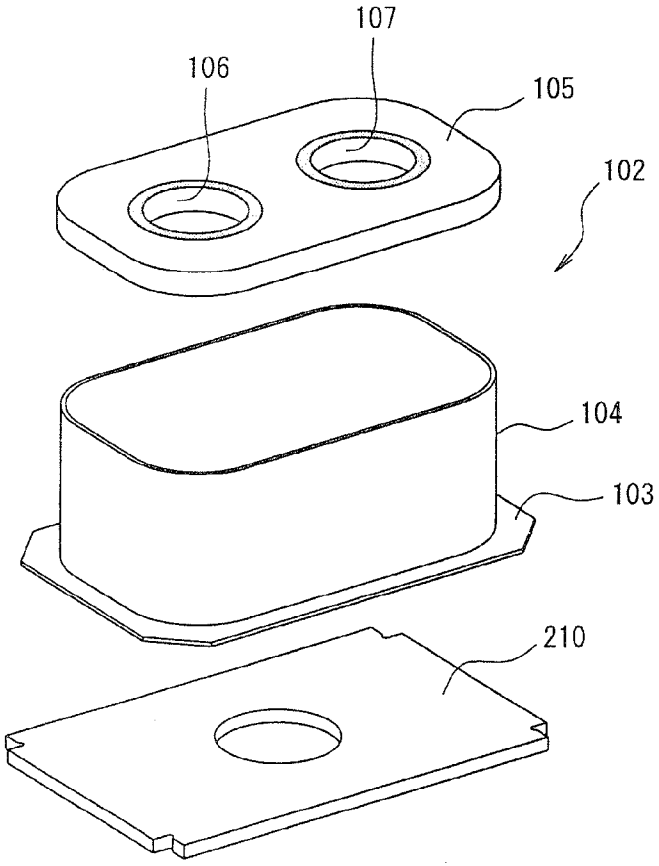

FIG. 1 is a sectional view showing one example of an electromagnetic switch according to the invention, while FIG. 2(*a*), 2(*b*) are exploded perspective views of a contact housing case. In FIGS. 1 and 2(*a*), 2(*b*), reference 10 is an electromagnetic contactor, and the electromagnetic contactor 10 comprises a contact device 100 disposed with a contact mechanism, and an electromagnet unit 200 that drives the contact device 100.

The contact device 100 has a contact housing case 102 housing a contact mechanism 101, as is clear from FIGS. 1 and 2(*a*), 2(*b*). The contact housing case 102, as shown in FIG. 2(*a*), includes a metal rectangular cylindrical body 104 having at the lower end portion thereof a metal flange portion 103 protruding outward, and a fixed contact support insulating substrate 105, configured of a plate-like ceramic insulating substrate, that closes the upper end of the metal rectangular cylindrical body 104.

The metal rectangular cylindrical body 104 is formed such that the flange portion 103 thereof is seal joined and fixed to an upper magnetic yoke 210 of the electromagnet unit 200, to be described hereafter.

Also, through holes 106, 107 for inserting a pair of fixed contacts 111, 112, to be described hereafter, are formed maintaining a predetermined interval in a central portion of the fixed contact support insulating substrate 105. A metalizing process is performed around the through holes 106, 107 on the upper surface side of the fixed contact support insulating substrate 105, and in a position on the lower surface side that contacts the rectangular cylindrical body 104. To carry out the metalizing process, in a state in which a plurality of fixed contact support insulating substrates 105 is arranged vertically and horizontally on a flat surface, a copper foil is formed around the through holes 106, 107 and in the position that contacts the rectangular cylindrical body 104.

The contact mechanism 101, as shown in FIG. 1, includes the pair of fixed contacts 111, 112 inserted and fixed in the through holes 106, 107 of the fixed contact support insulating substrate 105 of the contact housing case 102. Each of the fixed contacts 111, 112 includes a support conductor portion 114, having at the upper end thereof a flange portion protruding outward, inserted in each respective through hole 106, 107 of the fixed contact support insulating substrate 105, and a C-shaped portion 115, the inner side of which is opened, linked to the support conductor portion 114 and disposed on the lower surface side of the fixed contact support insulating substrate 105.

The C-shaped portion 115, being formed of an upper plate portion 116 extending to the outer side along the lower surface of the fixed contact support insulating substrate 105, an intermediate plate portion 117 extending downward from the outer side end portion of the upper plate portion 116, and a lower plate portion 118 extending from the lower end side of the intermediate plate portion 117, parallel with the upper plate portion 116, to the inner side, that is, in a direction facing the fixed contacts 111, 112, is formed in a C-shape wherein the upper plate portion 116 is added to an L-shape formed by the intermediate plate portion 117 and lower plate portion 118.

Herein, the support conductor portion 114 and C-shaped portion 115 are fixed by, for example, brazing in a state in which a pin 114*a* formed protruding from the lower end face of the support conductor portion 114 is inserted in a through hole 120 formed in the upper plate portion 116 of the C-shaped portion 115. The fixing of the support conductor portion 114 and C-shaped portion 115 is not limited to brazing. For example, the support conductor portion 114 may be fixed to the C-shaped portion 115 by fitting the pin 114*a* into the through hole 120, or forming an external thread on the pin 114*a*, and forming an internal thread in the through hole 120 to screw the two together.

Also, a magnetic plate 119 of a C-shape seen in plan view is attached so as to cover the inner side surface of the intermediate plate portion 117 of the C-shaped portion 115 of each fixed contacts 111, 112. By the magnetic plate 119 being disposed so as to cover the inner side surface of the intermediate plate portion 117 in this way, it is possible to shield a magnetic field generated by current flowing through the intermediate plate portion 117.

Because of this, when arcs are generated when contact portions 130*a* of a movable contact 130 move away upward from a position in which the contact portions 130*a* of the movable contact 130 contact portions 118*a* of the fixed contacts 111, 112, it is possible to prevent the magnetic field generated by the current flowing through the intermediate plate portion 117 from interfering with magnetic fields generated by the arcs generated between the contact portions 118*a* of the fixed contacts 111, 112 and the contact portions 130*a* of the movable contact 130. Consequently, it is possible to prevent the arcs from being difficult to interrupt due to the arcs being moved to the inner side along the movable contact 130 by electromagnetic repulsion forces wherein both the magnetic fields repulse each other. The magnetic plate 119 may be formed so as to cover the circumference of the intermediate plate portion 117, and it is sufficient that it is possible to shield the magnetic field generated by the current flowing through the intermediate plate portion 117.

Further, an insulating cover 121, made of a synthetic resin material, that limits arc generation is mounted on the C-shaped portion 115 of each of the fixed contacts 111, 112. The insulating cover 121 covers the inner peripheral surfaces of the upper plate portion 116 and intermediate plate portion 117 of the C-shaped portion 115, as shown in of FIG. 3(*a*), 3(*b*). The insulating cover 121 includes an L-shaped plate portion 122 that follows the inner peripheral surfaces of the upper plate portion 116 and intermediate plate portion 117, side plate portions 123, 124, each extending upward and outward from front and rear end portions of the L-shaped plate portion 122, that cover the side surfaces of the upper plate portion 116 and intermediate plate portion 117 of the C-shaped portion 115, and fitting portions 125, formed on the inward side from the upper ends of the side plate portions 123, 124, that fit onto a small diameter portion 114*b* formed on the support conductor portion 114 of each of the fixed contacts 111, 112.

Figure 3A:
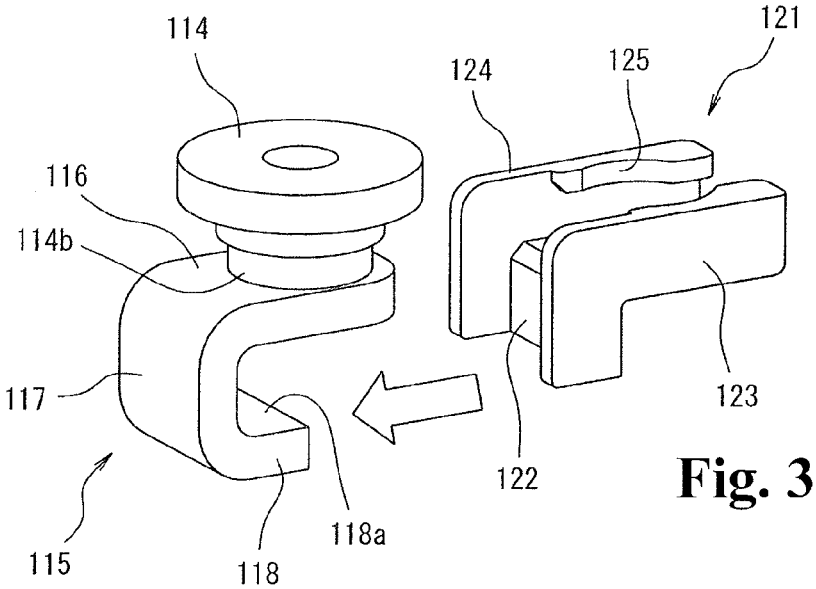
FIGS. 3(*a*)-3(*c*) are diagrams showing an insulating cover of a contact device, wherein FIG. 3(*a*) is a perspective view, FIG. 3(*b*) is a plan view before the insulating cover is mounted, and FIG. 3(*c*) is a plan view after the insulating cover is mounted.
Figure 3B:
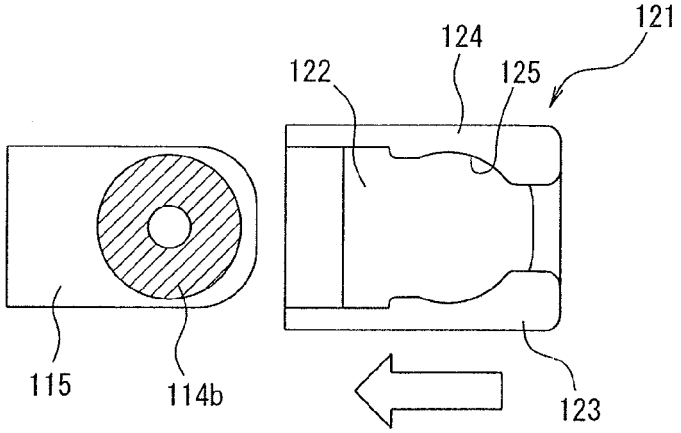
Figure 3C:
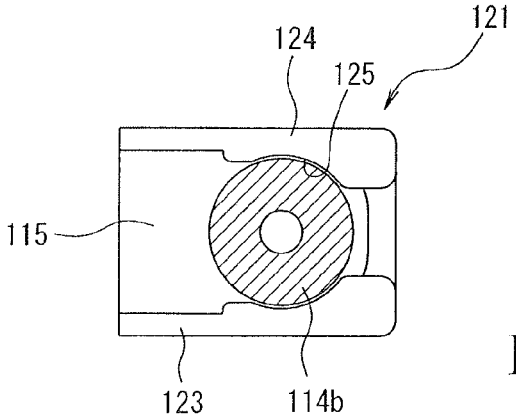

Consequently, the insulating cover 121 is placed in a state in which the fitting portions 125 are facing the small diameter portion 114*b* of the support conductor portion 114 of each of the fixed contacts 111, 112, as shown in of FIG. 3(*a*), 3(*b*), after which, as shown in FIG. 3(*c*), the fitting portions 125 are fitted onto the small diameter portion 114*b* of the support conductor portion 114 by pushing the insulating cover 121.

Figure 4A:
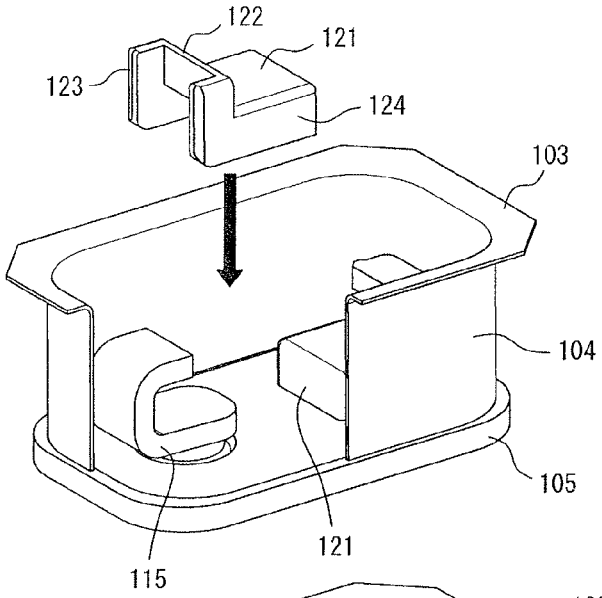
FIGS. 4(*a*)-4(*c*) are illustrations showing a method of mounting the insulating cover.
Figure 4B:
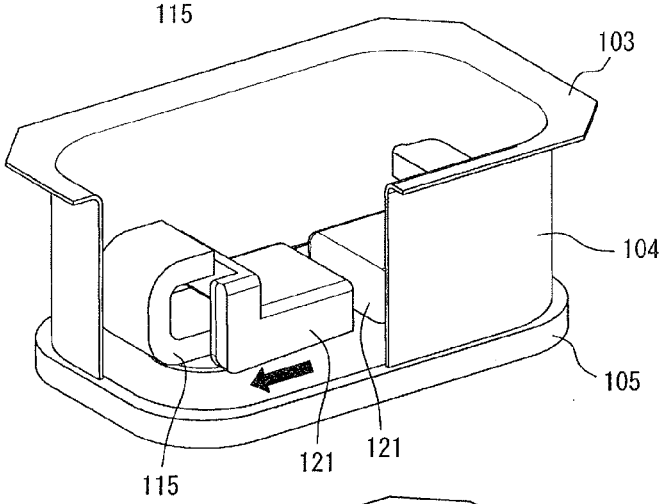
Figure 4C:
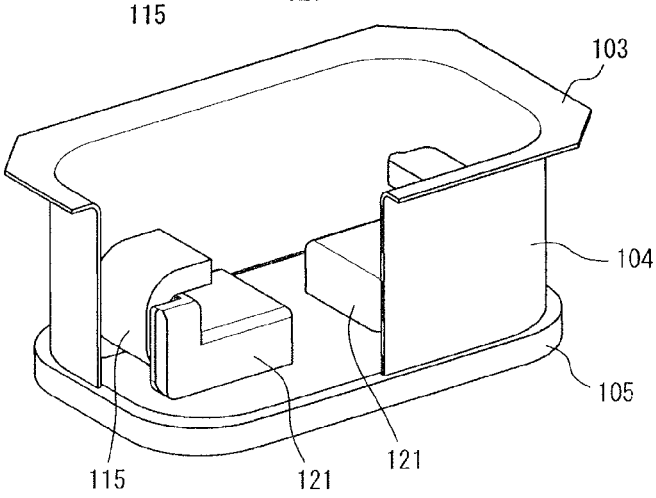

Actually, as shown in FIG. 4(*a*), in a state in which the contact housing case 102 with the fixed contacts 111, 112 mounted therein is turned with the fixed contact support insulating substrate 105 on the lower side, the insulating cover 121 is inserted from an upper opening portion into a space between the fixed contacts 111, 112, in a position turned upside down, the reverse of that in FIGS. 3(*a*)-3(*c*).

Next, in a state in which the fitting portions 125 are in contact with the fixed contact support insulating substrate 105, as shown in FIG. 4(*b*), the fitting portions 125 are fitted onto and fixed to the small diameter portion 114*b* of the support conductor portion 114 of each of the fixed contacts 111, 112 by pushing the insulating cover 121 to the outer side, as shown in FIG. 4(*c*).

By mounting the insulating cover 121 on the C-shaped portion 115 of each of the fixed contacts 111, 112 in this way, only an upper surface side of the lower plate portion 118, of the inner peripheral surface of the C-shaped portion 115, is exposed, thus forming the contact portion 118*a*.

Further, the movable contact 130 is disposed in such a way that the two end portions thereof are disposed each in the C-shaped portions 115 of the fixed contacts 111, 112. The movable contact 130 is supported by a connecting shaft 131 fixed in a movable plunger 215 of the electromagnet unit 200, to be described hereafter. The movable contact 130 is formed such that a central portion thereof in the vicinity of the connecting shaft 131 protrudes downward, whereby a depressed portion 132 is formed, and a through hole 133 into which to insert the connecting shaft 131 is formed in the depressed portion 132, as shown in FIG. 1.

A flange portion 131*a* protruding outward is formed at the upper end of the connecting shaft 131. The connecting shaft 131 is inserted from the lower end side thereof into a contact spring 134, and then inserted into the through hole 133 of the movable contact 130, thus bringing the upper end of the contact spring 134 to contact the flange portion 131*a*, and the movable contact 130 is positioned using, for example, a C-ring 135 so as to obtain a predetermined urging force from the contact spring 134.

The movable contact 130, in a released state, takes on a state in which the contact portions 130*a* at either end thereof and the contact portions 118*a* of the lower plate portions 118 of the C-shaped portions 115 of the fixed contacts 111, 112 are separate from each other while maintaining a predetermined interval. Also, the movable contact 130 is set so that, in a closed position, the contact portions at either end thereof contact with the contact portions 118*a* of the lower plate portions 118 of the C-shaped portions 115 of the fixed contacts 111, 112 at a predetermined contact pressure applied by the contact spring 134.

Figure 5:
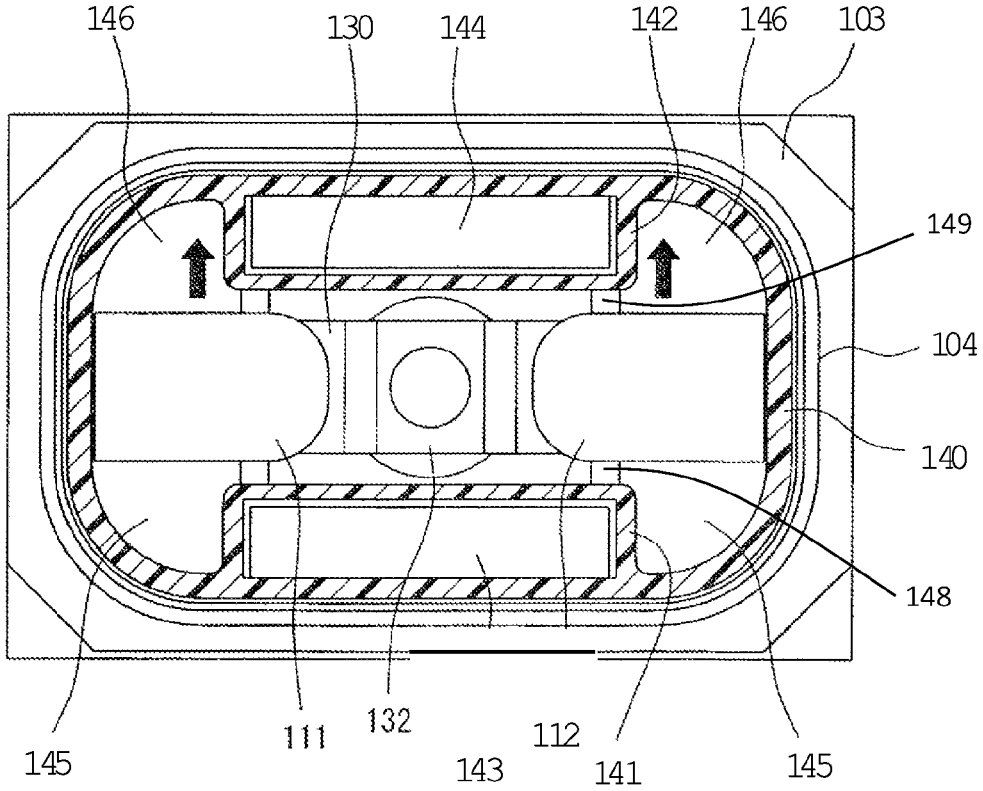
FIG. 5 is a sectional view taken along line A-A of FIG. 1.

Furthermore, an insulating cylindrical body 140 made of, for example, a synthetic resin is disposed on the inner peripheral surface of the rectangular cylindrical body 104 of the contact housing case 102. The insulating cylindrical body 140 is configured of a rectangular cylindrical portion 140*a* disposed on the inner peripheral surface of the rectangular cylindrical body 104 and a bottom plate portion 140*b* that closes the lower surface side of the rectangular cylindrical portion 140*a*. Magnet housing cylindrical bodies 141, 142 are formed one each on inner peripheral surfaces of the insulating cylindrical body 140 rectangular cylindrical portion 104*a* facing the respective side surfaces of the movable contact 130, as shown in FIG. 5. Arc extinguishing permanent magnets 143, 144 are inserted and fixed in the magnet housing cylindrical bodies 141, 142 respectively.

The arc extinguishing permanent magnets 143, 144 are magnetized in a thickness direction so that the mutually opposing magnetic pole faces thereof are homopolar, for example, N-poles. Also, the arc extinguishing permanent magnets 143, 144 are set so that both left-right direction end portions thereof are slightly inward of positions in which are facing the contact portions 118*a* of the fixed contacts 111, 112 and the contact portions of the movable contact 130, as shown in FIG. 5. Further, two pairs of arc extinguishing spaces 145, 146 are formed one pair on the left-right direction outer sides of each respective magnet housing cylindrical body 141, 142.

Also, movable contact guide members 148, 149 that limit turning of the movable contact 130 by making sliding contact with side edges of the magnet housing cylindrical bodies 141, 142 toward either end of the movable contact 130, are formed protruding.

By disposing the arc extinguishing permanent magnets 143, 144 on the inner peripheral surface side of the insulating cylindrical body 140 in this way, it is possible to bring the arc extinguishing permanent magnets 143, 144 near to the movable contact 130. Because of this, as shown in FIG. 6(*a*), magnetic fluxes $\phi$ emanating from the N-pole sides of the two arc extinguishing permanent magnets 143, 144 cross portions in which are facing the contact portions 118*a* of the fixed contacts 111, 112 and the contact portions 130*a* of the movable contact 130 in left and right directions, from the inner side to the outer side, with a high flux density.

Figure 6A:
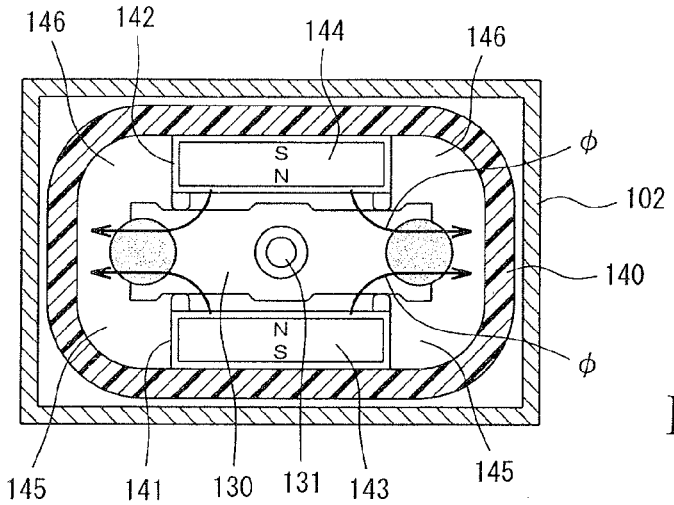
FIGS. 6(*a*)-6(*c*) are illustrations showing arc extinguishing by arc extinguishing permanent magnets according to the invention.
Figure 6B:
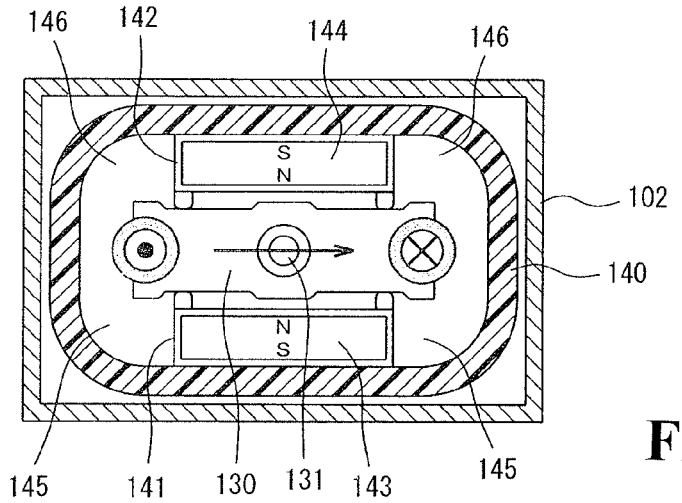
Figure 6C:
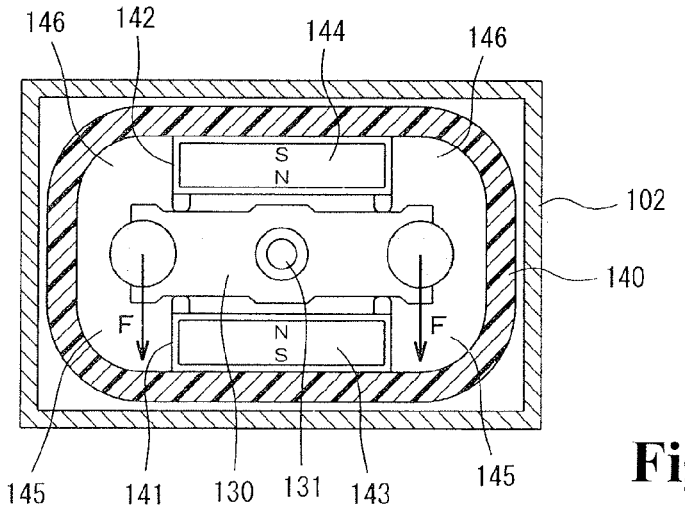

Consequently, assuming that the fixed contact 111 is connected to a current supply source and the fixed contact 112 is connected to a load side, in the closed state, the current flows from the fixed contact 111 through the movable contact 130 to the fixed contact 112, as shown in FIG. 6(*b*). Then, when shifting from the closed state to the released state by moving the movable contact 130 away upward from the fixed contacts 111, 112, arcs are generated between the contact portions 118*a* of the fixed contacts 111, 112 and the contact portions 130*a* of the movable contact 130.

The arcs are extended to the arc extinguishing space 145 side on the arc extinguishing permanent magnet 143 side by the magnetic fluxes $\phi$ from the arc extinguishing permanent magnets 143, 144. At this time, as the arc extinguishing spaces 145, 146 are formed as widely as the thickness of the arc extinguishing permanent magnets 143, 144, it is possible to obtain a long arc length, and thus possible to reliably extinguish the arcs.

Figure 7A:
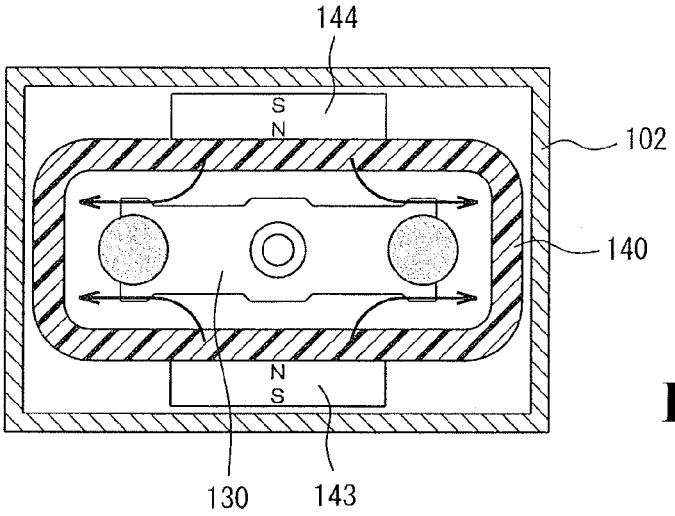
FIGS. 7(*a*)-7(*c*) are illustrations showing arc extinguishing when the arc extinguishing permanent magnets are disposed outside an insulating case.
Figure 7B:
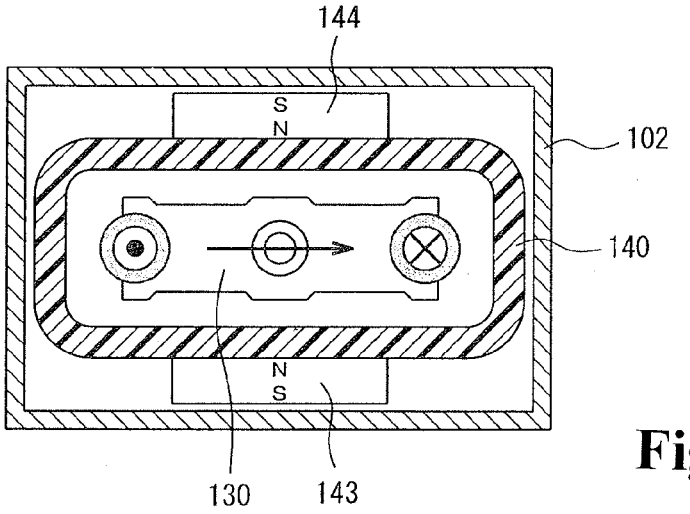
Figure 7C:
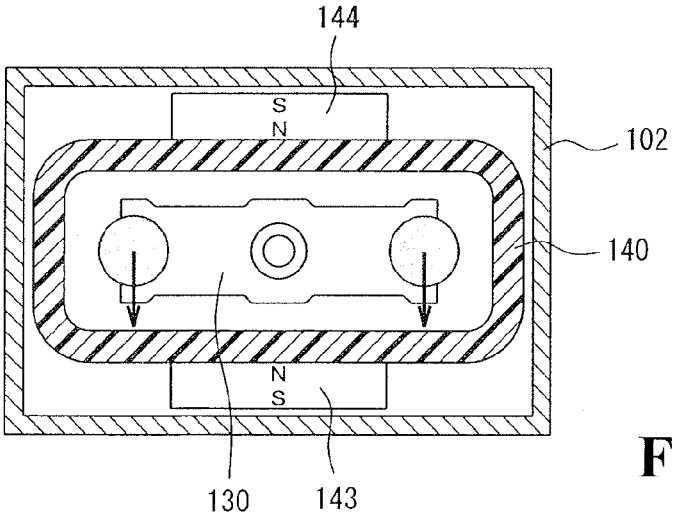

Incidentally, when the arc extinguishing permanent magnets 143, 144 are disposed on the outer side of the insulating cylindrical body 140, as shown in FIGS. 7(*a*) to 7(*c*), there is an increase in the distance to positions in which are facing the contact portions 118*a* of the fixed contacts 111, 112 and the contact portions 130*a* of the movable contact 130, and when permanent magnets the same as those in this embodiment are applied, the density of magnetic fluxes crossing the arcs decreases.

Because of this, Lorentz forces acting on arcs generated when shifting from the closed state to the released state decrease, and it is no longer possible to sufficiently extend the arcs. In order to improve arc extinguishing performance, it is necessary to increase the magnetism of the arc extinguishing permanent magnets 143, 144. Moreover, in order to shorten the distance between the arc extinguishing permanent magnets 143, 144 and the contact portions of the fixed contacts 111, 112 and movable contact 130, it is necessary to reduce the front-back direction depth of the insulating cylindrical body 140, and there is a problem that it is not possible to secure sufficient arc extinguishing space to extinguish the arcs.

However, according to the heretofore described embodiment, as the arc extinguishing permanent magnets 143, 144 are disposed on the inner side of the insulating cylindrical body 140, it is possible to solve all the heretofore described problems arising when the arc extinguishing permanent magnets 143, 144 are disposed on the outer side of the insulating cylindrical body 140.

The electromagnet unit 200, as shown in FIG. 1, has a magnetic yoke 201 of a flattened U-shape when seen from the side, and a cylindrical auxiliary yoke 203 is fixed to the central portion of a bottom plate portion 202 of the magnetic yoke 201. A spool 204 is disposed on the outer side of the cylindrical auxiliary yoke 203.

The spool 204 is configured of a central cylindrical portion 205 in which the cylindrical auxiliary yoke 203 is inserted, a lower flange portion 206 protruding radially outward from the lower end portion of the central cylindrical portion 205, and an upper flange portion 207 protruding radially outward from slightly below the upper end of the central cylindrical portion 205. Further, an exciting coil 208 is wound in a housing space configured of the central cylindrical portion 205, lower flange portion 206, and upper flange portion 207.

Further, an upper magnetic yoke 210 is fixed between the upper ends forming the open end of the magnetic yoke 201. A through hole 210*a* facing the central cylindrical portion 205 of the spool 204 is formed in the central portion of the upper magnetic yoke 210.

Further, the movable plunger 215, in which a return spring 214 is disposed between a bottom portion of the movable plunger 215 and the bottom plate portion 202 of the magnetic yoke 201, is disposed in the central cylindrical portion 205 of the spool 204 so as to be able to slide up and down. A peripheral flange portion 216 protruding radially outward is formed on an upper end portion of the movable plunger 215 protruding upward from the upper magnetic yoke 210.

Also, a permanent magnet 220 formed in an annular shape is fixed to the upper surface of the upper magnetic yoke 210 so as to enclose the peripheral flange portion 216 of the movable plunger 215. The permanent magnet 220 has a through hole 221 enclosing the peripheral flange portion 216. The permanent magnet 220 is magnetized in an up-down direction, that is, in a thickness direction, so that, for example, the upper end side is an N-pole while the lower end side is an S-pole. The shape of the through hole 221 of the permanent magnet 220 is taken to be a shape tailored to the shape of the peripheral flange portion 216, and the shape of the outer peripheral surface can be any shape, such as a circle or a quadrate.

Further, an auxiliary yoke 225 of an external shape the same as that of the permanent magnet 220, and having a through hole 224 with an inner diameter smaller than the outer diameter of the peripheral flange portion 216 of the movable plunger 215, is fixed to the upper end surface of the permanent magnet 220. The peripheral flange portion 216 of the movable plunger 215 abuts against the lower surface of the auxiliary yoke 225.

Also, the connecting shaft 131 that supports the movable contact 130 is screwed to the upper end surface of the movable plunger 215.

Further, in the released state, the movable plunger 215 is urged upward by the return spring 214, and takes on a released position in which the upper surface of the peripheral flange portion 216 abuts against the lower surface of the auxiliary yoke 225. In this state, the contact portions 130*a* of the movable contact 130 move upward to be away from the contact portions 118*a* of the fixed contacts 111, 112, thus taking on a state in which the current is interrupted.

In this released state, a state is secured in which the peripheral flange portion 216 of the movable plunger 215 is attracted to the auxiliary yoke 225 by the magnetism of the permanent magnet 220, and in combination with the urging force of the return spring 214, the movable plunger 215 abuts against the auxiliary yoke 225 without moving downward unexpectedly due to external vibration, shock, or the like.

Further, the movable plunger 215 is covered with a cap 230 made of a non-magnetic body and formed in a bottomed cylindrical shape, and a flange portion 231 formed on the open end side of the cap 230 so as to extend radially outward is seal joined to the lower surface of the upper magnetic yoke 210. By so doing, a hermetic receptacle, wherein the contact housing case 102 and cap 230 are in communication via the through hole 210*a* of the upper magnetic yoke 210, is formed. Further, a gas, such as a hydrogen gas, a nitrogen gas, a mixed gas of hydrogen and nitrogen, air, or $SF_6$, is enclosed in the hermetic receptacle formed by the contact housing case 102 and cap 230.

Next, a description will be given of an operation of the heretofore described embodiment.

For now, it is assumed that the fixed contact 111 is connected to, for example, a power supply source that supplies a large current, while the fixed contact 112 is connected to a load.

In this state, it is assumed that the exciting coil 208 in the electromagnet unit 200 is in a non-excited state, and there exists a released state wherein no exciting force causing the movable plunger 215 to descend is being generated in the electromagnet unit 200. In this released state, the movable plunger 215 is urged in an upward direction away from the upper magnetic yoke 210 by the return spring 214. Simultaneously with this, magnetic attraction caused by the magnetism of the permanent magnet 220 acts on the auxiliary yoke 225, and the peripheral flange portion 216 of the movable plunger 215 is attracted. Because of this, the upper surface of the peripheral flange portion 216 of the movable plunger 215 abuts against the lower surface of the auxiliary yoke 225.

Because of this, the contact portions 130*a* of movable contact 130 of the contact mechanism 101 connected to the movable plunger 215 via the connecting shaft 131 are separated by a predetermined distance upward from the contact portions 118*a* of the fixed contacts 111, 112. Because of this, the current path between the fixed contacts 111, 112 is in an interrupted state, and the contact mechanism 101 is in a state in which the contacts are opened.

In this way, as the urging force of the return spring 214 and the magnetic attraction of the annular permanent magnet 220 both act on the movable plunger 215 in the released state, the movable plunger 215 does not move downward unexpectedly due to external vibration, shock, or the like, and it is thus possible to reliably prevent malfunction.

On the exciting coil 208 of the electromagnet unit 200 being excited in the released state, an exciting force is generated in the electromagnet unit 200, and the movable plunger 215 is pressed downward against the urging force of the return spring 214 and the magnetic attraction of the annular permanent magnet 220. Then, the descent of the movable plunger 215 is stopped by the lower surface of the peripheral flange portion 216 by abutting against the upper surface of the upper magnetic yoke 210.

By the movable plunger 215 descending in this way, the movable contact 130 connected to the movable plunger 215 via the connecting shaft 131 also descends, and the contact portions 130*a* of the movable contact 130 contact the contact portions 118*a* of the fixed contacts 111, 112 with the contact pressure of the contact spring 13.

Because of this, a closed contact state wherein the large current of the external power supply source is supplied via the fixed contact 111, movable contact 130, and fixed contact 112 to the load, is attained.

At this time, electromagnetic repulsion forces are generated between the fixed contacts 111, 112 and the movable contact 130 in a direction such as to cause the contacts of the movable contact 130 to open.

However, as the fixed contacts 111, 112 are formed such that each C-shaped portion 115 is formed of the upper plate portion 116, intermediate plate portion 117, and lower plate portion 118, as shown in FIG. 1, the current in the upper plate portion 116 and lower plate portion 118 and the current in the opposing movable contact 130 flow in opposite directions. Because of this, from the relationship between magnetic fields formed by the lower plate portions 118 of the fixed contacts 111, 112 and the current flowing through the movable contact 130, it is possible, in accordance with Fleming's left-hand rule, to generate Lorentz forces that press the movable contact 130 against the contact portions 118*a* of the fixed contacts 111, 112.

Because of the Lorentz forces, it is possible to oppose the electromagnetic repulsion forces generated in the contact opening direction between the contact portions 118*a* of the fixed contacts 111, 112 and the contact portions 130*a* of the movable contact 130, and thus possible to reliably prevent the contact portions 130*a* of the movable contact 130 from opening. Because of this, it is possible to reduce the pressing force of the contact spring 134 supporting the movable contact 130, and as a result, it is also possible to reduce the thrust generated in the exciting coil 208. Therefore, it is possible to reduce the size of the overall configuration of the electromagnetic contactor.

When interrupting the supply of current to the load in the closed contact state of the contact mechanism 101, the exciting of the exciting coil 208 of the electromagnet unit 200 is stopped.

By so doing, the exciting force causing the movable plunger 215 to move downward in the electromagnet unit 200 stops, and as a result, the movable plunger 215 is raised by the urging force of the return spring 214, and the magnetic attraction of the annular permanent magnet 220 increases as the peripheral flange portion 216 nears the auxiliary yoke 225.

By the movable plunger 215 rising, the movable contact 130 connected via the connecting shaft 131 rises. As a result of this, the movable contact 130 contacts the fixed contacts 111, 112 for as long as contact pressure is applied by the contact spring 134. Subsequently, an opened contact state wherein the movable contact 130 moves upward to be away from the fixed contacts 111, 112 at the point at which the contact pressure of the contact spring 134 stops is attained.

On the opened contact state being attained, arcs are generated between the contact portions 118*a* of the fixed contacts 111, 112 and the contact portions 130*a* of the movable contact 130, and the state in which current is conducted is continued due to the arcs. At this time, as the insulating cover 121 is mounted covering the upper plate portion 116 and intermediate plate portion 117 of the C-shaped portion 115 of each of the fixed contacts 111, 112, it is possible to cause the arcs to be generated only between the contact portions 118*a* of the fixed contacts 111, 112 and the contact portions 130*a* of the movable contact 130. Because of this, it is possible to stabilize the arc generation state, and thus possible to improve arc extinguishing performance.

Also, as the upper plate portion 116 and intermediate plate portion 117 of each C-shaped portion 115 is covered with the insulating cover 121, it is possible to secure an insulating distance with the insulating cover 121 between each end portion of the movable contact 130 and the upper plate portion 116 and intermediate plate portion 117 of each C-shaped portion 115, and thus possible to reduce the movable direction height of the movable contact 130. Consequently, it is possible to reduce the side of the contact device 100.

Furthermore, as the inner side surface of the intermediate plate portion 117 of each of the fixed contacts 111, 112 is covered with the magnetic plate 119, a magnetic field generated by the current flowing through the intermediate plate portion 117 is shielded by the magnetic plate 119. Because of this, it does not happen that magnetic fields generated by arcs generated between the contact portions 118*a* of the fixed contacts 111, 112 and the contact portions 130*a* of the movable contact 130 interfere with the magnetic field generated by the current flowing through the intermediate plate portion 117, and it is thus possible to prevent the arcs from being affected by the magnetic field generated by the current flowing through the intermediate plate portion 117.

Meanwhile, as the opposing magnetic pole faces of the arc extinguishing permanent magnets 143, 144 are N-poles, and the outer sides thereof are S-poles, the magnetic flux emanating from the N-pole of each arc extinguishing permanent magnet 143, 144, seen in plan view as shown in FIG. 6(*a*), crosses an arc generation portion of a portion in which are facing the contact portion 118*a* of the fixed contact 111 and the contact portion 130*a* of the movable contact 130, from the inner side to the outer side in a longitudinal direction of the movable contact 130, and reaches the S-pole, whereby a magnetic field is formed. In the same way, the magnetic flux crosses an arc generation portion of the contact portion 118*a* of the fixed contact 112 and the contact portion 130*a* of the movable contact 130, from the inner side to the outer side in the longitudinal direction of the movable contact 130, and reaches the S-pole, whereby a magnetic field is formed.

Consequently, the magnetic fluxes of the arc extinguishing magnets 143, 144 both cross between the contact portion 118*a* of the fixed contact 111 and the contact portion 130*a* of the movable contact 130 and between the contact portion 118*a* of the fixed contact 112 and the contact portion 130*a* of the movable contact 130, in mutually opposite directions in the longitudinal direction of the movable contact 130.

Because of this, a current I flows from the fixed contact 111 side to the movable contact 130 side between the contact portion 118*a* of the fixed contact 111 and the contact portion 130*a* of the movable contact 130, as shown in FIG. 6(*b*), and the orientation of the magnetic fluxes $\phi$ is in a direction from the inner side toward the outer side. Because of this, in accordance with Fleming's left-hand rule, large Lorentz forces F act toward the arc extinguishing space 145 side, perpendicular to the longitudinal direction of the movable contact 130 and perpendicular to the switching direction of the contact portion 118*a* of the fixed contact 111 and the movable contact 130, as shown in FIG. 6(*c*).

Due to the Lorentz force F, an arc generated between the contact portion 118*a* of the fixed contact 111 and the contact portion 130*a* of the movable contact 130 is greatly extended so as to pass from the side surface of the contact portion 118*a* of the fixed contact 111 through inside the arc extinguishing space 145, reaching the upper surface side of the movable contact 130, and is extinguished.

Also, at the lower side and upper side of the arc extinguishing space 145, a magnetic flux inclines to the lower side and upper side with respect to the orientation of the magnetic flux between the contact portion 118*a* of the fixed contact 111 and the contact portion 130*a* of the movable contact 130. Because of this, the arc extended to the arc extinguishing space 145 is further extended by the inclined magnetic flux in the direction of the corner of the arc extinguishing space 145, and it is possible to increase the arc length, and thus possible to obtain good interruption performance.

Meanwhile, the current I flows from the movable contact 130 side to the fixed contact 112 side between the contact portion 118*a* of the fixed contact 112 and the movable contact 130, and the orientation of the magnetic flux $\phi$ is in a rightward direction from the inner side toward the outer side, as shown in FIG. 6(*b*). Because of this, in accordance with Fleming's left-hand rule, a large Lorentz force F acts toward the arc extinguishing space 145 side, perpendicular to the longitudinal direction of the movable contact 130 and perpendicular to the switching direction of the contact portion 118*a* of the fixed contact 112 and the movable contact 130.

Due to the Lorentz force F, an arc generated between the contact portion 118*a* of the fixed contact 112 and the movable contact 130 is greatly extended so as to pass from the upper surface side of the movable contact 130 through inside the arc extinguishing space 145, reaching the side surface side of the fixed contact 112, and is extinguished.

Also, at the lower side and upper side of the arc extinguishing space 145, as heretofore described, a magnetic flux inclines to the lower side and upper side with respect to the orientation of the magnetic flux between the contact portion 118*a* of the fixed contact 112 and the contact portion 130*a* of the movable contact 130. Because of this, the arc extended to the arc extinguishing space 145 is further extended by the inclined magnetic flux in the direction of the corner of the arc extinguishing space 145, and it is possible to increase the arc length, and thus possible to obtain good interruption performance.

Meanwhile, in the closed state of the electromagnetic contactor 10, when adopting a released state in a state in which a regenerative current flows from the load side to the direct current power source side, the previously described direction of current in FIG. 6(*b*) is reversed, meaning that the Lorentz forces F act on the arc extinguishing space 146 side with the exception that the arcs are extended to the arc extinguishing space 146 side, the same arc extinguishing function is fulfilled.

At this time, as the arc extinguishing permanent magnets 143, 144 are disposed in the magnet housing cylindrical bodies 141, 142 formed in the insulating cylindrical body 140, the arcs do not directly contact the arc extinguishing permanent magnets 143, 144. Because of this, it is possible to stably maintain the magnetic characteristics of the arc extinguishing permanent magnets 143, 144, and thus possible to stabilize interruption performance.

Also, as it is possible to cover and insulate the inner peripheral surface of the metal rectangular cylindrical body 104 with the insulating cylindrical body 140, there is no short circuiting of the arcs when the current is interrupted, and it is thus possible to reliably carry out current interruption.

Furthermore, as it is possible to carry out the insulating function, the function of positioning the arc extinguishing permanent magnets 143, 144, and the function of protecting the arc extinguishing permanent magnets 143, 144 from the arcs, with the one insulating cylindrical body 140, it is possible to reduce manufacturing cost.

In this way, according to the heretofore described embodiment, as the contact device 100 is formed such that the C-shaped portions 115 of the fixed contacts 111, 112 and the contact spring 134 that imparts the contact pressure of the movable contact 130 are disposed in parallel, it is possible to reduce the height of the contact mechanism 101 as compared with when the fixed contacts, movable contact, and contact spring are disposed in series. Because of this, it is possible to reduce the size of the contact device 100.

Also, as the arc extinguishing permanent magnets 143, 144 are disposed on the inner peripheral surfaces, of the insulating cylindrical body 140 configuring the contact housing case 102, facing the side edges of the movable contact 130, it is possible to bring the arc extinguishing permanent magnets 143, 144 near to the contact faces of the pair of fixed contacts 111, 112 and the movable contact 130, and it is possible to increase the density of magnetic fluxes crossing the arcs from the inner side toward the outer side in an extension direction of the movable contact 130, meaning that it is possible to reduce the magnetism of the arc extinguishing permanent magnets 143, 144 for obtaining a necessary magnetic flux density, and thus possible to carry out a reduction in cost of the arc extinguishing permanent magnets.

Also, as it is possible to increase the distance between the side edges of the movable contact 130 and the respective inner peripheral surfaces of the insulating cylindrical body 140 by an amount equivalent to the thickness of the arc extinguishing permanent magnets 143, 144, it is possible to provide the sufficiently large arc extinguishing spaces 145, 146, and thus possible to reliably carry out the extinguishing of the arcs.

Furthermore, as the movable contact guide members 148, 149 in sliding contact with the side edges of the movable contact are formed protruding in positions, on the permanent magnet housing cylindrical bodies 141, 142 housing the arc extinguishing permanent magnets 143, 144, facing the movable contact 130, it is possible to reliably prevent turning of the movable contact 130.

Next, a description will be given, referring to FIG. 8, of a second embodiment of the invention.

The second embodiment is formed such that the configuration of the contact housing case is modified.

Figure 8:
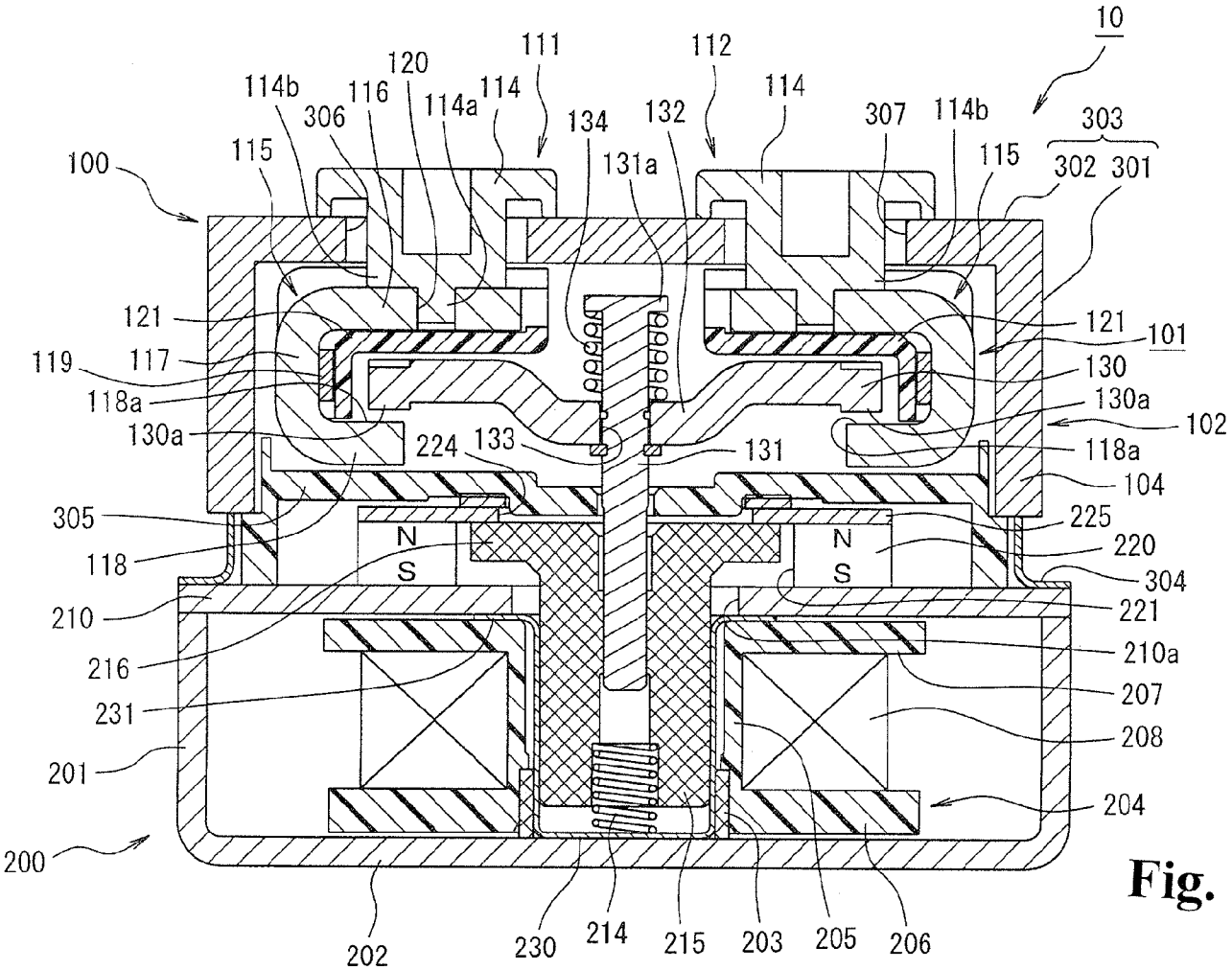
FIG. 8 is a sectional view showing a second embodiment of the electromagnetic contactor according to the invention.

That is, in the second embodiment, as shown in FIG. 8 and FIG. 2(*b*), a rectangular cylindrical portion 301 and a top plate portion 302 that closes the upper end of the rectangular cylindrical portion 301 are molded integrally from a ceramic or synthetic resin material to form a tub-shaped body 303, a metalizing process is performed on the open end face side of the tub-shaped body 303 to form a metal foil, and a metal connecting member 304 is seal joined to the metal foil, thus configuring the contact housing case 102.

Further, a bottom plate portion 305, formed from, for example, a synthetic resin, corresponding to the bottom plate portion 104*b* in the previously described first embodiment is disposed on a bottom surface side inner peripheral surface of the tub-shaped body 303.

Also, insertion holes 306, 307 to insert the fixed contacts 111, 112 are formed in the top plate portion 302, in the same way as in the previously described fixed contact support insulating substrate 105, and the fixed contacts 111, 112 are supported in the insertion holes 306, as in the previously described first embodiment.

Other configurations having configurations the same as those in the first embodiment, the same reference numerals and signs are given to portions corresponding to those in FIG. 1, and a detailed description thereof will be omitted.

According to the second embodiment, as the tub-shaped body 303 molded integrally from an insulating material configures the contact housing case 102, it is possible to easily form the airtight contact housing case 102 with a small number of man hours, and it is possible to reduce the number of parts.

Also, in the heretofore described first and second embodiment, a description has been given of a case in which the opposing magnetic pole faces of the arc extinguishing permanent magnets 143, 144 are N-poles but, not being limited to this, even when the opposing magnetic pole faces of the arc extinguishing permanent magnets 143, 144 are S-poles, it is possible to obtain the same advantage as in the heretofore described first and second embodiment, excepting that the direction in which the magnetic fluxes cross the arcs and the direction of the Lorentz forces are opposite.

Figure 9A:
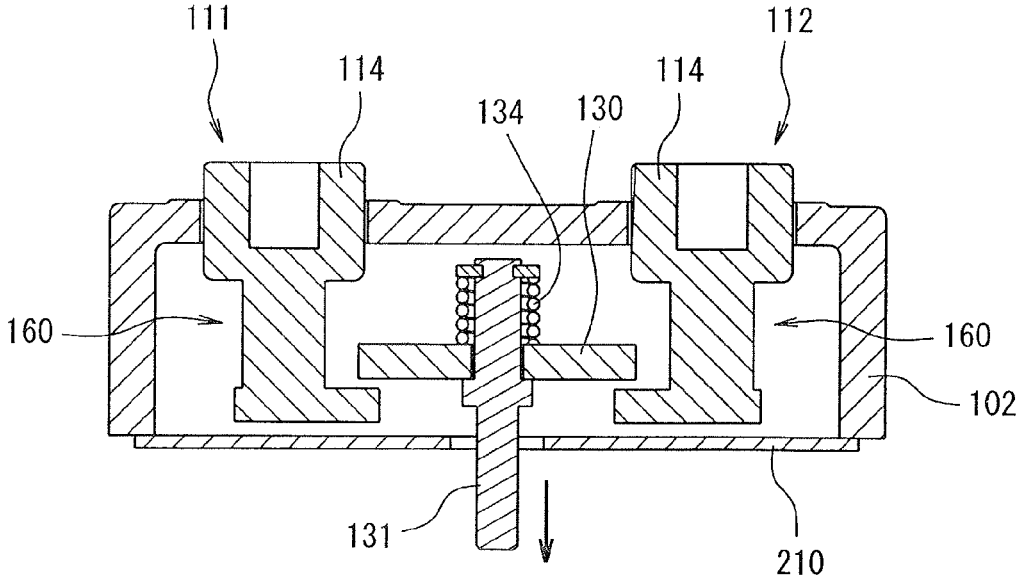
FIG. 9(*a*), 9(*b*) are diagrams showing a modification example of the contact device of the invention, wherein FIG. 9(*a*) is a sectional view, and FIG. 9(*b*) is a perspective view.
Figure 9B:
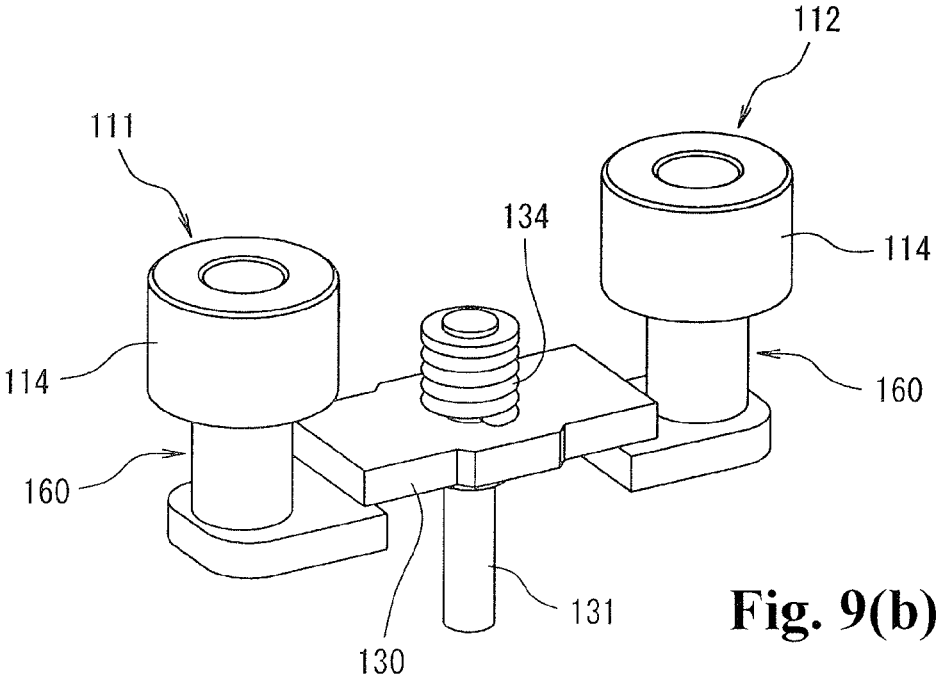

In the heretofore described first and second embodiment, a description has been given of a case in which the C-shaped portion 115 is formed in each of the fixed contacts 111, 112 but, not being limited to this, an L-shaped portion 160, of a shape such that the upper plate portion 116 of the C-shaped portion 115 is omitted, may be connected to the support conductor portion 114, as shown in FIG. 9(*a*), 9(*b*).

In this case too, in the closed contact state wherein the movable contact 130 contacts the fixed contacts 111, 112, it is possible to cause magnetic fluxes generated by the current flowing through a vertical plate portion of the L-shaped portion 160 to act on portions in which the fixed contacts 111, 112 and the movable contact 130 are in contact. Because of this, it is possible to increase the magnetic flux density in the portions in which the fixed contacts 111, 112 and the movable contact 130 are in contact, generating Lorentz forces that opposes the electromagnetic repulsion forces.

Figure 10A:
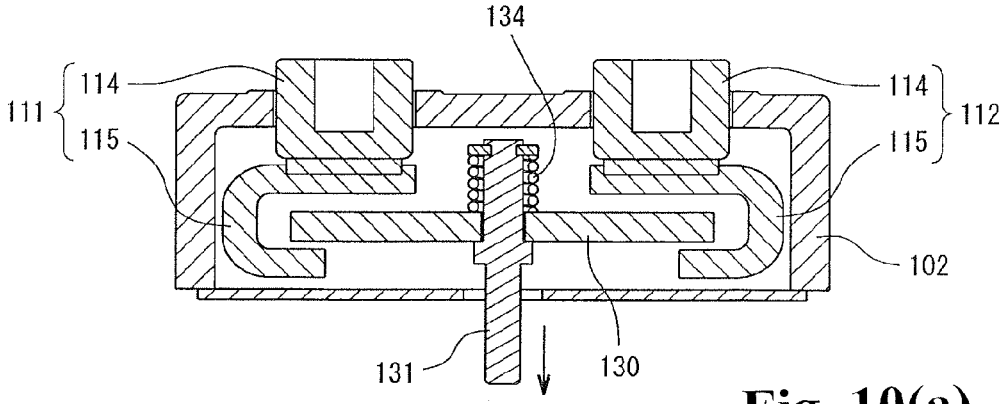
FIG. 10(*a*), 10(*b*) are diagrams showing another modification example of the contact device of the invention, wherein FIG. 10(*a*) is a sectional view, and FIG. 10(*b*) is a perspective view.
Figure 10B:
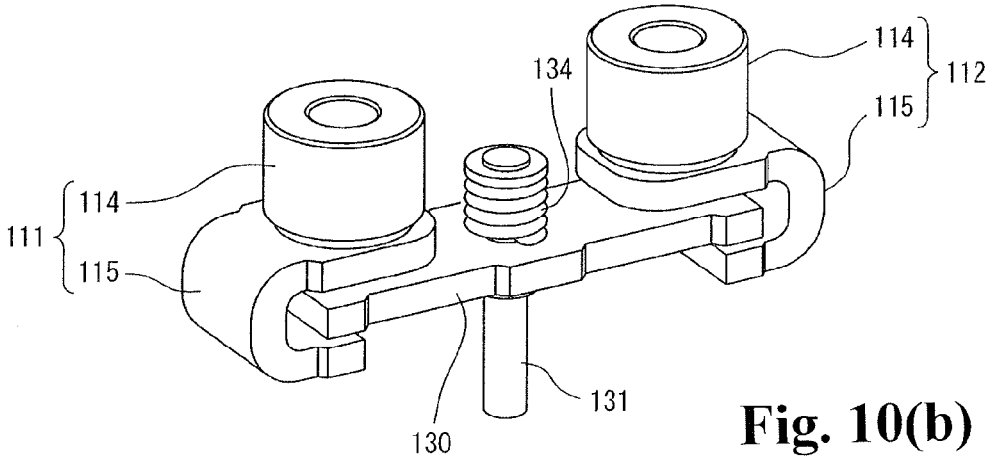

Also, in the heretofore described embodiments, a description has been given of a case in which the movable contact 130 has the depressed portion 132 in the central portion thereof but, not being limited to this, the depressed portion 132 may be omitted, forming a flat plate, as shown in FIG. 10(*a*), 10(*b*).

Also, in the heretofore described embodiments, a description has been given of a case in which the insulating cylindrical body 140 supporting the arc extinguishing permanent magnets 143, 144 is molded integrally, but not being limited to this.

Figure 11:
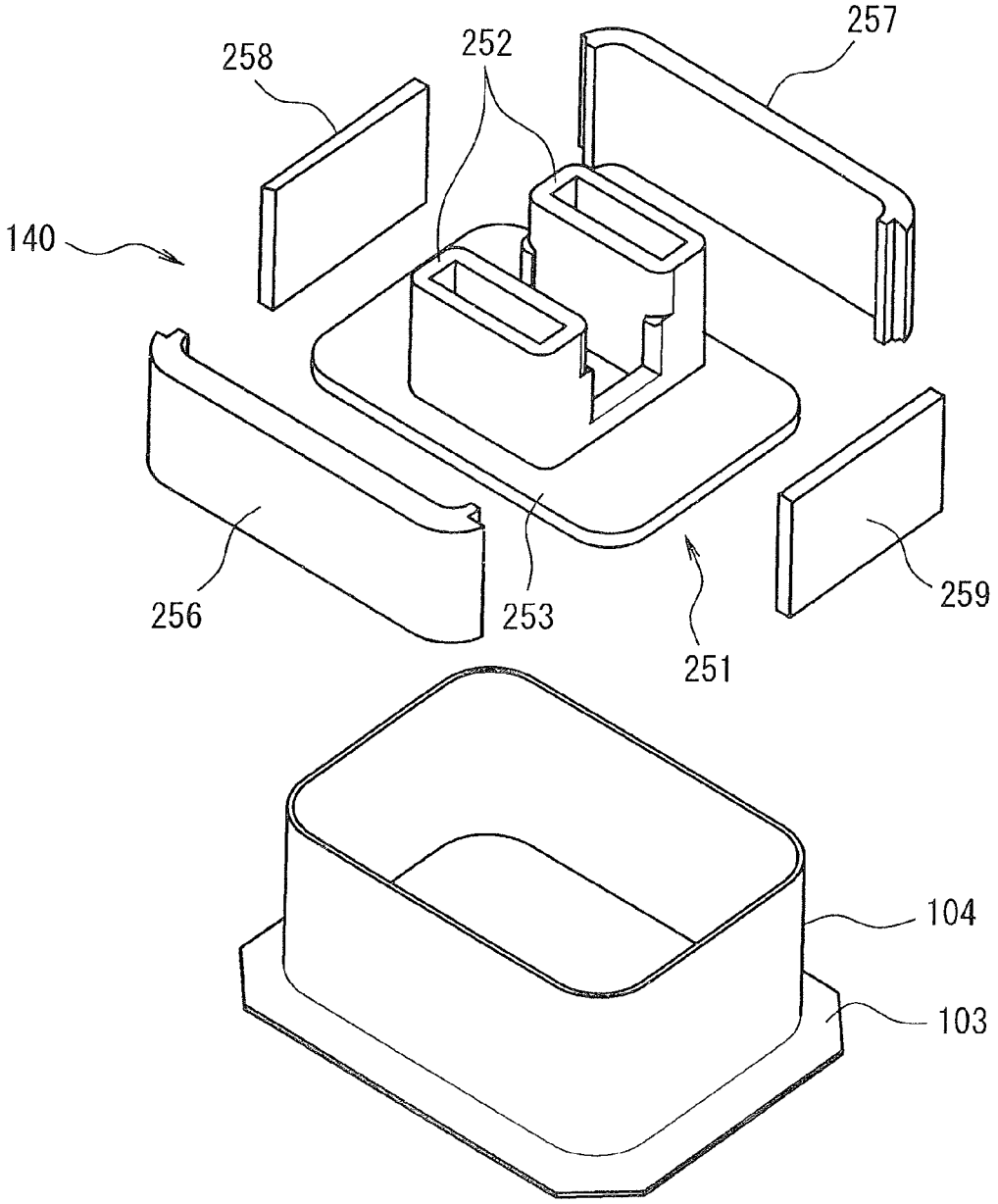
FIG. 11 is a perspective view showing another example of an insulating cylindrical body configuring the contact housing case.
Figure 12:
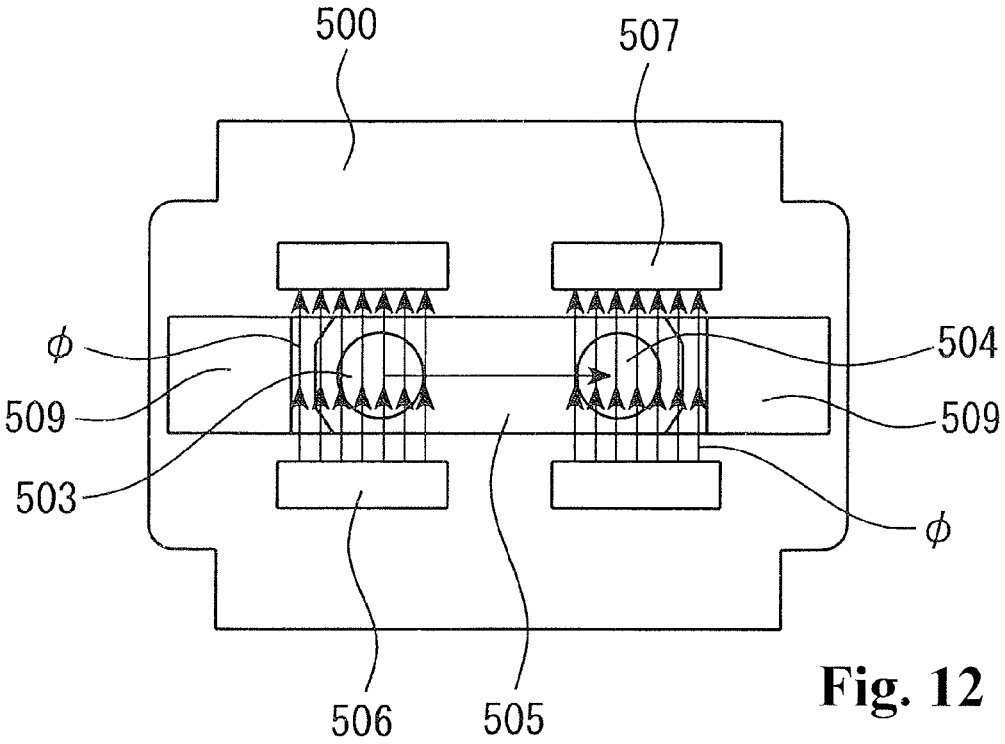
FIG. 12 is a cross-sectional view showing a heretofore known example.
Figure 13:
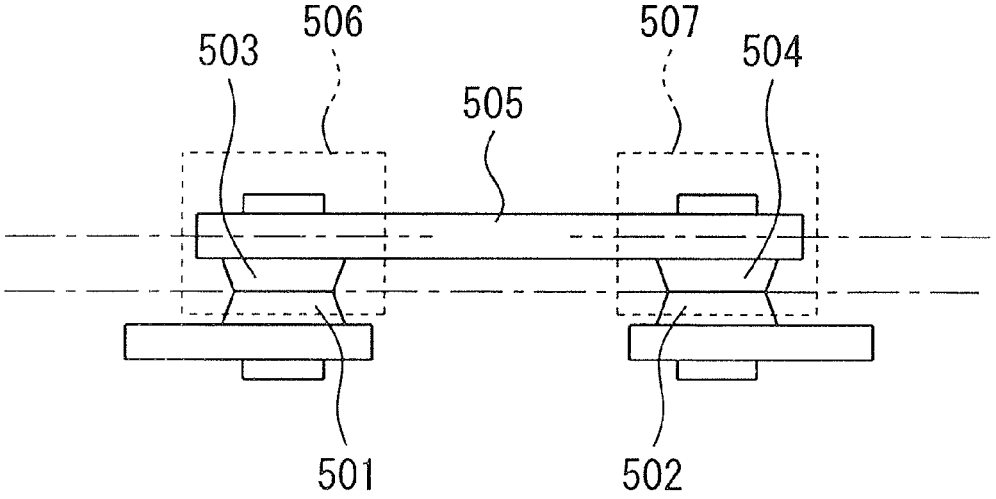
FIG. 13 is a schematic diagram showing a relationship between contact portions and arc extinguishing means in an energized state in the heretofore known example.
Figure 14:
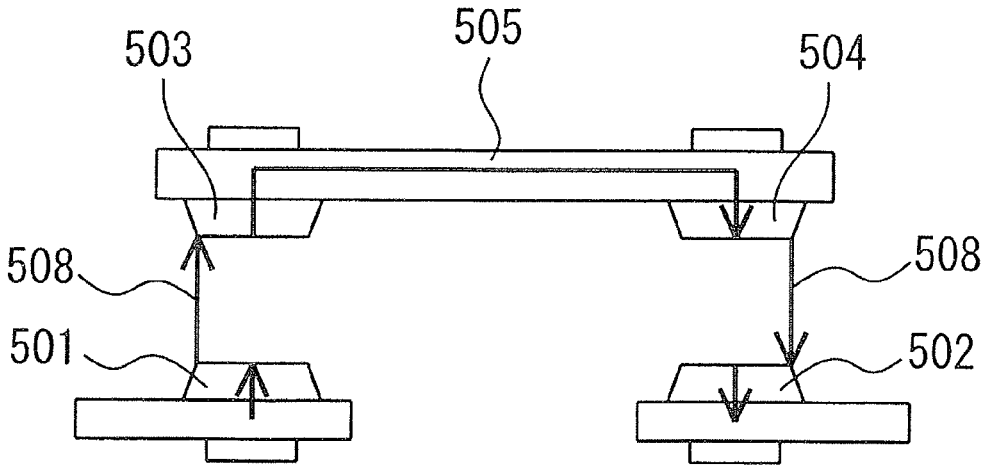
FIG. 14 is an illustration showing how arcs are generated in the heretofore known example.
Figure 15:
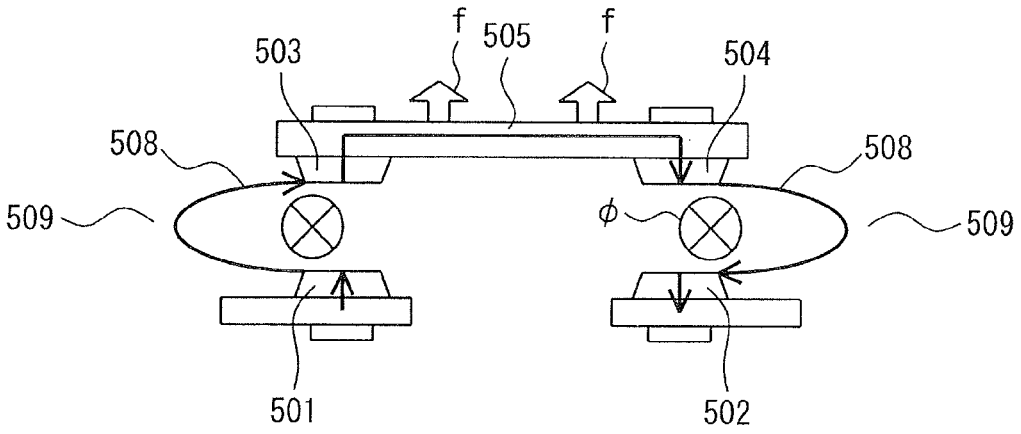
FIG. 15 is a schematic diagram showing a relationship between an orientation of arcs and current and an orientation of magnetic fluxes due to the arc extinguishing means in an interrupted state in the heretofore known example.
Figure 16:
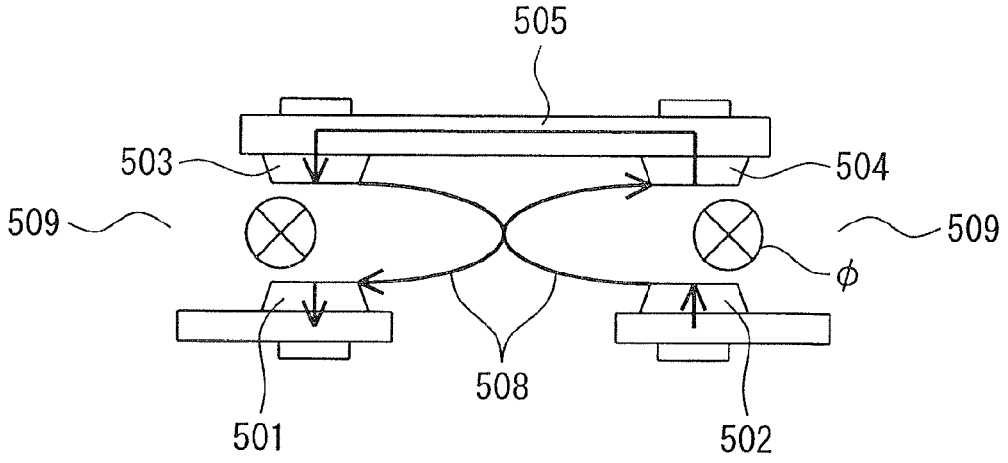
FIG. 16 is a schematic diagram same as FIG. 14 in a state in which the orientation of current is reversed in the heretofore known example.
Figure 17:
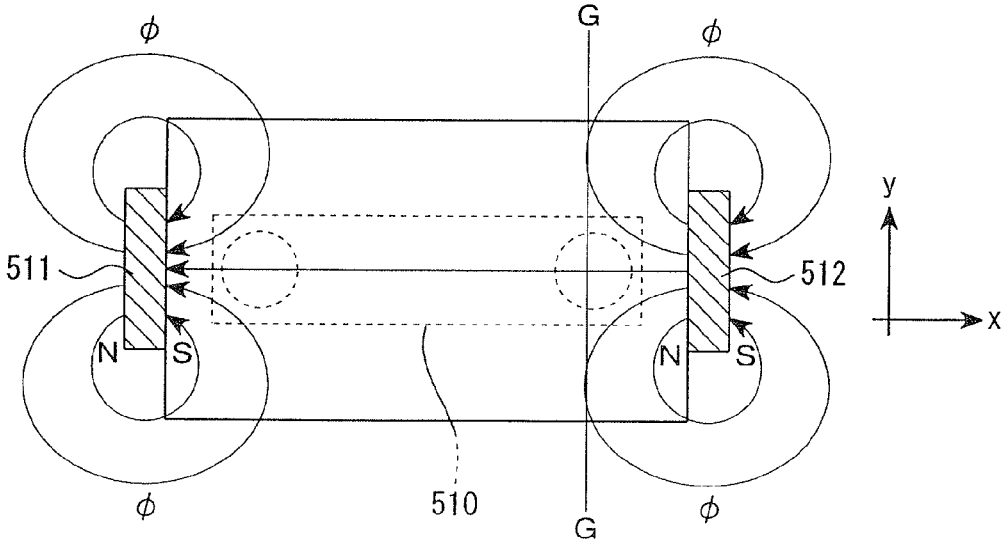
FIG. 17 is a plan view showing how magnetic fields are generated in another heretofore known example.
Figure 18:
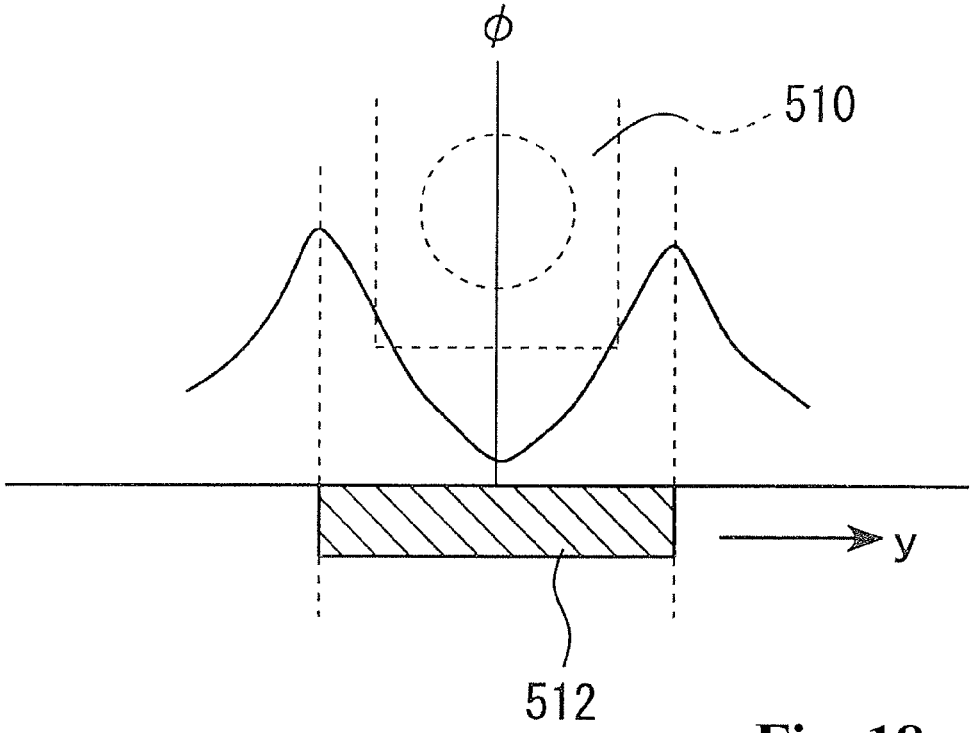
FIG. 18 is a characteristic curve chart showing a magnetic flux distribution along line G-G of FIG. 17.

That is, as shown in FIG. 11, the insulating cylindrical body 140 may be formed by combining and disposing four side plate portions 256 to 259 configuring sidewalls at the front, back, left, and right end portions of a bottom plate portion 253 on which is formed a magnet housing portion 252 of a base member 251, and connecting the side plate portions 256 to 259. In this case, as a sidewall portion is divided into the four side plate portions 256 to 259, it is easy to manufacture, as compared with when the whole is formed integrally. Furthermore, a rectangular cylindrical body wherein the four side plate portions 256 to 259 are integrated may be formed.

Also, in the heretofore described embodiments, a description has been given of a case in which the connecting shaft 131 is screwed to the movable plunger 215, but the movable plunger 215 and connecting shaft 131 may also be formed integrally.

Also, a description has been given of a case in which the connection of the connecting shaft 131 and movable contact 130 is formed such that the flange portion 131*a* is formed on the leading end portion of the connecting shaft 131, and the lower end of the movable contact 130 is fixed with a C-ring after the connecting shaft 131 is inserted into the contact spring 134 and movable contact 130. However, not being limited to this, the embodiment may be structured such that a positioning large diameter portion is formed protruding radially in the C-ring position of the connecting shaft 131, the contact spring 134 disposed after the movable contact 130 abuts the large diameter portion, and the upper end of the contact spring 134 fixed with the C-ring.

Also, in the heretofore described embodiments, a description has been given of a case in which the hermetic receptacle is configured of the contact housing case 102 and cap 230, and a gas is enclosed in the hermetic receptacle but, not being limited to this, the gas enclosure may be omitted when the interrupted current is small.

REFERENCE SIGNS LIST

10 . . . Electromagnetic contactor, 100 . . . Contact device, 101 . . . Contact mechanism, 102 . . . Contact housing case, 104 . . . Rectangular cylindrical body, 105 . . . Fixed contact support insulating substrate, 111, 112 . . . Fixed contact, 114 . . . Support conductor portion, 115 . . . C-shaped portion, 116 . . . Upper plate portion, 117 . . . Intermediate plate portion, 118 . . . Lower plate portion, 118*a* . . . Contact portion, 121 . . . Insulating cover, 122 . . . L-shaped plate portion, 123, 124 . . . Side plate portion, 125 . . . Fitting portion, 130 . . . Movable contact, 130*a* . . . Contact portion, 131 . . . Connecting shaft, 132 . . . Depressed portion, 134 . . . Contact spring, 140 . . . Insulating cylindrical body, 141, 142 . . . Magnet housing pocket, 143, 144 . . . Arc extinguishing permanent magnet, 145, 146 . . . Arc extinguishing space, 160 . . . L-shaped portion, 200 . . . Electromagnet unit, 201 . . . Magnetic yoke, 203 . . . Cylindrical auxiliary yoke, 204 . . . Spool, 208 . . . Exciting coil, 210 . . . Upper magnetic yoke, 214 . . . Return spring, 215 . . . Movable plunger, 216 . . . Peripheral flange portion, 220 . . . Permanent magnet, 225 . . . Auxiliary yoke, 301 . . . Rectangular cylindrical portion, 302 . . . Top plate portion, 303 . . . Tub-shaped body, 304 . . . Connecting member, 305 . . . Bottom plate portion

What is claimed is:

1. An electromagnetic contactor, comprising:

a contact housing case formed of an insulating material, and including a cylindrical portion and a pair of rectangular magnetic housings projecting inwardly from an inner peripheral surface of the cylindrical portion to form arc extinguishing spaces for extinguishing arcs, each being located between one side of each of the pair of magnetic housings and each corner of the cylindrical portion, a pair of fixed contacts each including a contact portion at one end thereof and housed inside the contact housing case, a movable contact including contact portions formed at two ends thereof to face the contact portions of the pair of fixed contacts and arranged between the pair of rectangular magnetic housings inside the contact housing case, to contact to or separate from the contact portions of the pair of fixed contacts, and arc extinguishing permanent magnets each having a distance in a longitudinal direction of the movable contact, which is shorter than a distance between the contact portions of the pair of fixed contacts and the contact portions of the movable contact, and arranged in the pair of rectangular magnetic housings to sandwich the movable contact therebetween, the arc extinguishing permanent magnets being magnetized so that magnetic pole faces facing each other have same polarity, wherein each of the arc extinguishing spaces has a width corresponding to a thickness of each of the arc extinguishing permanent magnets so that the arc extinguishing spaces have large spaces to extinguish the arcs, respectively, at sides of the arc extinguishing permanent magnets.

2. The electromagnetic contactor according to claim 1, wherein each of the arc extinguishing permanent magnets is covered with an insulating member formed on the inner peripheral surface of the cylindrical portion and the pair of rectangular magnetic housings.

3. The electromagnetic contactor according to claim 2, wherein the insulating member includes movable contact guide members slide contacting the movable contact to restrain rotation of the movable contact.

4. The electromagnetic contactor according to claim 1, further comprising:

a magnetic plate disposed to cover each of the pair of fixed contacts, to shield a magnetic field generated by a current flowing through each of the pair of fixed contacts.

5. The electromagnetic contactor according to claim 1, wherein each of the contact portions of the pair of fixed contacts is sandwiched between two of the arc extinguishing spaces.

6. The electromagnetic contactor according to claim 1, wherein each of the pair of rectangular magnetic housings is formed of the inner peripheral surface of the cylindrical portion and wall portions protruding inwardly from the inner peripheral surface of the cylindrical portion to surround the arc extinguishing permanent magnet.

7. The electromagnetic contactor according to claim 1, wherein the cylindrical portion includes flat portions arranged parallel to the longitudinal direction of the movable contact and curved portions arranged at two ends of each of the flat portions; and the pair of rectangular magnetic housings are disposed on inner surfaces of the flat portions, and the arc extinguishing spaces are disposed in a space defined by the one side of each of the pair of magnetic housings and inner surfaces of the curved portions.

* * * * *